US007683747B2

(12) United States Patent
Song et al.

(10) Patent No.: US 7,683,747 B2
(45) Date of Patent: Mar. 23, 2010

(54) MEMS RF-SWITCH USING SEMICONDUCTOR

(75) Inventors: Il-jong Song, Suwon-si (KR); Dong-ha Shim, Seoul (KR); Hyung-jae Shin, Seongnam-si (KR); Soon-cheol Kweon, Seoul (KR); Che-heung Kim, Yongin-si (KR); Sang-hun Lee, Seoul (KR); Young-tack Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 436 days.

(21) Appl. No.: 11/179,460

(22) Filed: Jul. 13, 2005

(65) Prior Publication Data

US 2006/0012940 A1 Jan. 19, 2006

(30) Foreign Application Priority Data

Jul. 13, 2004 (KR) ..... 10-2004-0054449

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 6,100,477 A * 8/2000 Randall et al. ..... 200/181
6,115,231 A * 9/2000 Shirakawa ..... 361/233
6,291,331 B1 * 9/2001 Wang et al. ..... 438/618
6,426,687 B1 * 7/2002 Osborn ..... 333/262
6,869,815 B2 * 3/2005 Gasparyan et al. ..... 438/29
7,022,542 B2 * 4/2006 Combi et al. ..... 438/52
7,242,273 B2 * 7/2007 Isobe et al. ..... 335/78

FOREIGN PATENT DOCUMENTS

JP 2003-200394 7/2003

* cited by examiner

*Primary Examiner*—Anh T Mai
*Assistant Examiner*—Bernard Rojas
(74) *Attorney, Agent, or Firm*—Sughrue Mion, PLLC

(57) ABSTRACT

A MEMS RF-switch is provided for controlling switching on/off of transmission of AC signals. The MEMS RF-switch of the present invention includes: a first electrode coupled to one terminal of the power source; a semiconductor layer combined with an upper surface of the first electrode, and forming a potential barrier to become insulated when a bias signal is applied from the power source; and a second electrode disposed at a predetermined distance away from the semiconductor layer, and being coupled to the other terminal of the power source, wherein the second electrode contacts the semiconductor layer when a bias signal is applied from the power source. Therefore, although the bias signal may not be cut off, free electrons and holes are recombined in the semiconductor layer, whereby charge buildup and sticking can be prevented.

11 Claims, 7 Drawing Sheets

(a) $V_{bias} > 0$ (b) $V_{bias} = 0$

MEMS RF-SWITCH USING SEMICONDUCTOR

CROSS-REFERENCE TO RELATED APPLICATIONS

This application claims priority from Korean Patent Application No. 10-2004-0054449, filed on Jul. 13, 2004, the entire disclosure of which is incorporated herein by reference.

BACKGROUND OF THE INVENTION

1. Field of the Invention

Apparatuses consistent with the present invention relate in general to a RF (Radio Frequency)-switch which allows an AC (alternating current) signal to pass therethrough by a bias voltage. More specifically, the present invention relates to a MEMS RF-switch using a semiconductor layer between a first electrode and a second electrode, thereby preventing charge buildup and sticking.

2. Description of the Related Art

Technical advances in MEMS (Micro Electro Mechanical System) have brought the development of a RF-switch based on the MEMS. In general, MEMS RF-switches have performance advantages over traditional semiconductor switches. For instance, the MEMS RF-switch provides extremely low insertion loss when the switch is on, and exhibits a high attenuation level when the switch is off. In contrast to semiconductor switches, the MEMS RF-switch features very low power consumption and a high frequency level (approximately 70 GHz).

The MEMS RF-switch has a MIM (Metal/Insulator/Metal) structure, that is, an insulator is sandwiched between two electrodes. Therefore, when a bias voltage is applied to the MEMS RF-switch, the switch acts as a capacitor, allowing an AC signal to pass therethrough.

FIG. 1 is a cross-sectional view of a related art MEMS RF-switch. As shown in FIG. 1, the MEMS RF-switch includes a substrate 11, a first electrode 12, an insulator 13, and a second electrode 15. Particularly, the MEMS RF-switch in FIG. 1 has a cap structure where the second electrode 15 packages the first electrode 12 and the insulator 13. Also, an air gap 14 exists between the second electrode 15 and the insulator 13.

When a bias voltage $V_{bias}$ is applied in the direction shown in FIG. 1, the second electrode 15 is thermally expanded and shifts in the direction of the arrow, thereby making contact with the insulator 13. As such, the first electrode 12, the insulator 13 and the second electrode 15 act as a capacitor together, and the RF-switch is turned on, which in turn allows an RF signal to pass therethrough at a predetermined frequency band. However, if the bias voltage $V_{bias}$ is not applied, the second electrode 15 shrinks and is separated from the insulator 13. As a result, the RF-switch is turned off and cannot allow the RF signal to pass therethrough.

When the bias voltage is applied, the second electrode 15 is charged positively resulting in a buildup of positive (+) charges, and the first electrode 12 is charged negatively resulting in a buildup of (−) charges. On the right hand side of FIG. 1 is a graph illustrating charges, or the quantities of electric charges, on the first electrode 12, the insulator 13 and the second electrode 15, respectively, of an ideal RF-switch. Referring to the graph in FIG. 1, the first electrode 12 which corresponds to the interval ($0\sim x_1$) is charged with $-Q_p$, the second electrode 15 which corresponds to the interval ($x_3\sim x_4$) is charged with $+Q_p$. If the bias voltage is cut off in this state the charge turns back to 0. Meanwhile, the charge on the insulator 13 is maintained at 0, independent of the application of a bias voltage.

In practice, however, charge buildup often occurs to the insulator 13. Thus, the detected charge on the insulator 13 is not always 0.

FIGS. 2A and 2B are graphs for explaining charge buildup and sticking that occur to a non-ideal RF-switch. FIG. 2A illustrates a case when a bias voltage $V_{bias}$ is applied. As shown, the first electrode 12 is charged with $-Q_p$, the second electrode 15 is charged with $+Q_1$. At this time, $+Q_2$ is built up on the insulator 13. $Q_1$ and $Q_2$ satisfy a relation of $Q_1+Q_2=Q_p$. As such, although the bias voltage $V_{bias}$ may be applied, a repulsive force is generated by the insulator 13 which is charged positively with $+Q_2$ until the second electrode 12 is charged positively with greater than $+Q_2$. Therefore, the RF-switch is not turned on until a bias voltage with a certain magnitude is applied. As a consequence, switching time is increased.

Meanwhile, once the RF-switch is on, the insulator is charged with $+Q_2$ and the first electrode 12 is charged with $-Q_2$ even though the bias voltage may be cut off. As a result, sticking occurs because the second electrode 15 and the insulator 13 are not separated. Moreover, the RF-switch may not be turned off at all even when the bias voltage is completely cut off.

SUMMARY OF THE INVENTION

It is, therefore, an aspect of the present invention to provide a MEMS RF-switch using a semiconductor layer between a first electrode and a second electrode, thereby preventing charge buildup and sticking.

To achieve the above aspects of the present invention, there is provided a MEMS RF-switch, connected to an external power source, for controlling switching on or off of transmission of AC signals, the MEMS RF-switch including: a first electrode coupled to one terminal of the power source; a semiconductor layer combined with an upper surface of the first electrode, and forming a potential barrier to become insulated when a bias signal is applied from the power source; and a second electrode disposed at a predetermined distance away from the semiconductor layer, and being coupled to the other terminal of the power source, wherein the second electrode contacts the semiconductor layer when the bias signal is applied from the power source.

Also, the semiconductor layer may include a P-type semiconductor layer and an N-type semiconductor layer.

In addition, the MEMS RF-switch may further include: a substrate connected to a lower surface of the first electrode for supporting the first electrode, the semiconductor layer and the second electrode.

In this exemplary embodiment, the second electrode has a cap structure covering the first electrode and the semiconductor at the predetermined distance away from the semiconductor layer; or a cantilever structure, comprising a support part connected to a predetermined region of the substrate, and a protruded part supported by the support part for being a predetermined distance away from the semiconductor layer.

Additionally, the semiconductor layer may be made of one of intrinsic semiconductor, P-type semiconductor and N-type semiconductor.

Another aspect of the present invention provides a MEMS RF-switch comprising: a P-type substrate having a region on the upper surface doped by an N-type semiconductor; a first electrode connected to a lower surface of the P-type substrate and coupled to one terminal of an external power source; and a second electrode disposed at a predetermined distance away from the N-type semiconductor, and being coupled to the other terminal of the power source, wherein the second electrode contacts the N-semiconductor when a bias signal is applied from the power source.

Yet another aspect of the present invention provides a MEMS RF-switch comprising: an N-type substrate having a region on the upper surface doped by a P-type semiconductor; a first electrode connected to a lower surface of the N-type substrate and coupled to one terminal of an external power source; and a second electrode disposed at a predetermined distance away from the P-type semiconductor, and being coupled to the other terminal of the power source, wherein the second electrode contacts the P-type semiconductor when a bias signal is applied from the power source.

In addition, at least one of the first electrode and the second electrode may be made of one of metals, amorphous silicon and poly-silicon.

BRIEF DESCRIPTION OF THE DRAWINGS

The above and other aspects of the present invention will become more apparent by describing certain exemplary embodiments of the present invention with reference to the accompanying drawings, in which.

DETAILED DESCRIPTION OF THE EXEMPLARY EMBODIMENTS

Exemplary embodiments of the present invention will now be described more fully with reference to the accompanying drawings.

Figure 3:
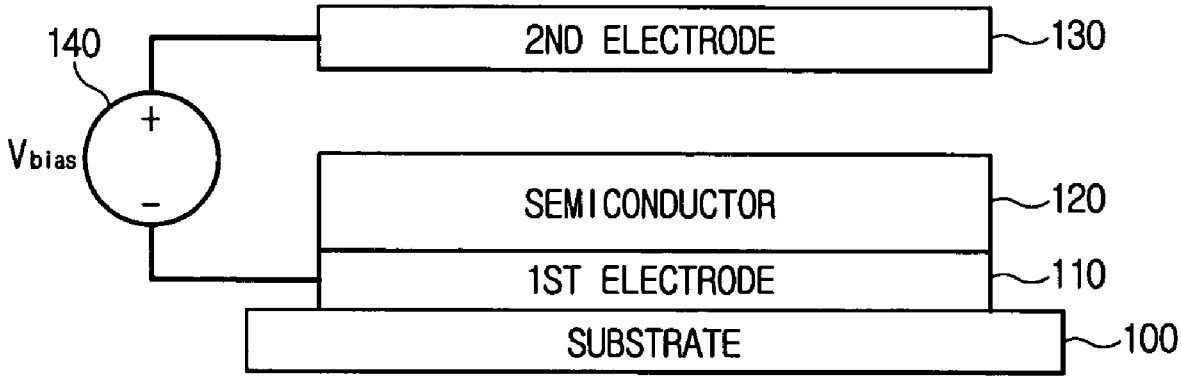
FIG. 3 is a schematic cross-sectional view of a MEMS RF-switch according to an exemplary embodiment of the present invention.

FIG. 3 is a schematic cross-sectional view of a MEMS RF-switch according to an exemplary embodiment of the present invention. As shown in FIG. 3, the MEMS RF-switch includes a first electrode 110, a semiconductor layer 120, and a second electrode 130. Also, the MEMS RF-switch further includes a substrate 100 for support.

The first electrode 110 and the second electrode 130 are coupled to both ends of an external power source 140, respectively. Therefore, when a bias signal $V_{bias}$ is applied from the external power source 140 the first electrode 110 and the second electrode 130 are charged with −Q and +Q, respectively.

The second electrode 130 is fabricated to be thinner than its surrounding support structure (not shown) so that it is thermally expanded by the application of the bias signal and makes contact with the semiconductor layer 120. In this case, the bias signal is applied to the semiconductor layer 120 as a reverse bias signal. Thus, the semiconductor layer 120 generates a potential barrier by the layout of free electrons and holes therein and exhibits an insulating property. In result, the first electrode 110, the semiconductor layer 120 and the second electrode 130 form a capacitor together, allowing an RF signal to pass therethrough at a predetermined frequency band.

Examples of the semiconductor layer 120 include intrinsic semiconductors, P-type semiconductors and N-type semiconductors. The P-type semiconductor or the N-type semiconductor can be obtained by carrying out a process of doping, i.e., adding donor impurity and acceptor impurity to the semiconductor, separately. Since the recombination of free electrons and holes takes place in the semiconductor layer 120 when the bias signal is cut off, charge buildup does not occur.

Figure 4A:
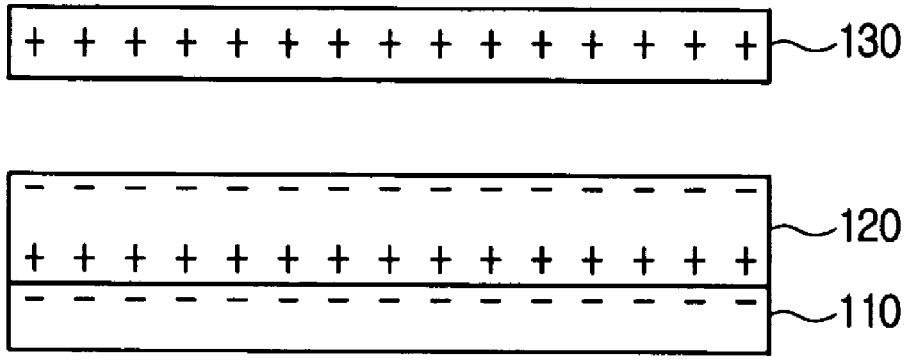
FIGS. 4A and 4B a illustrate the operation of the RF-switch of FIG. 3.
Figure 4B:
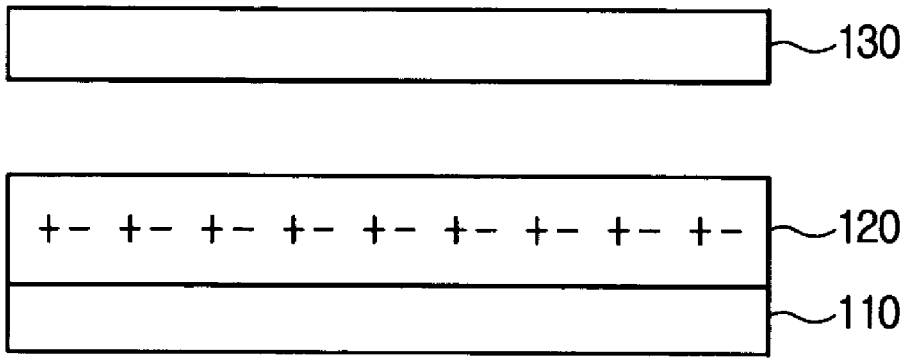

FIGS. 4A and 4B are diagrams which depict the operation of the RF-switch of FIG. 3. FIG. 4A illustrates charge states of the first and second electrodes 110, 130 and the semiconductor layer 120 when the bias signal $V_{bias}$ is applied. As shown in FIG. 4A, the first electrode 110 is charged negatively, and the second electrode 130 is charged positively. The second electrode 130 is thermally expanded and makes contact with the semiconductor layer 120. Free electrons are laid out on the upper portion of the semiconductor layer 120 due to the (+) charges on the second electrode 130, and holes are laid out on the lower portion of the semiconductor layer 120 due to the (−) charges on the first electrode 110. As such, the potential barrier is formed inside the semiconductor layer 120 and as a result, a depletion region is expanded between the first electrode 110 and the semiconductor layer 120. In this manner, the semiconductor layer 120 becomes insulated and can allow the RF signal only to pass therethrough. Consequently, the MEMS RF-switch is turned on.

Figure 5:
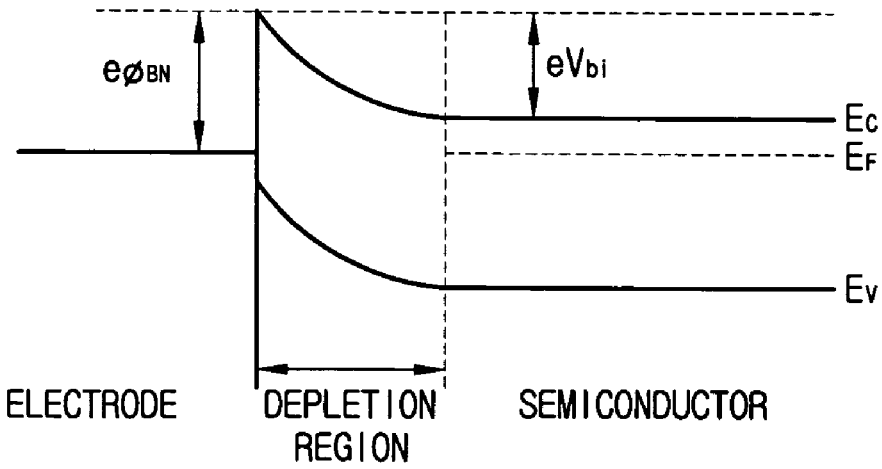
FIG. 5 illustrates the operational principle of the RF-switch of FIG. 3.

FIG. 5 graphically explains how the semiconductor layer 120 becomes insulated. Referring to FIG. 5, the energy levels on the semiconductor layer 120 are indicated by $E_c$ (conduction band), $E_f$ (Fermi level), and $E_v$ (valance band). The first electrode 110 and the semiconductor layer 120 form a schottky diode structure. Accordingly, the semiconductor layer 120 becomes a cathode and the first electrode 110 becomes an anode. If the bias signal is applied to the second electrode 130 in this structure, a reverse bias is applied to the schottky diode. That is to say, as shown in FIG. 5, the potential barrier is created between the first electrode 110 and the semiconductor layer 120. The energy level of the potential barrier is greater in the amount of $e_{\Phi Bn}$ than that of the first electrode, and greater in the amount of $e_{Vbi}$ than the conduction band $E_c$ of the semiconductor layer. Thus, the movement of free electrons and holes between the first electrode 110 and the semiconductor layer 120 are interfered, and the semiconductor layer 120 becomes insulated. Additionally, the energy level of the first electrode 110 may be the same with the Fermi level.

FIG. 4B illustrates charge states of the first and second electrodes 110, 130 and the semiconductor layer when the bias voltage $V_{bias}$ =zero, that is the external power source 140 is cut off. In this case, the charge on each of the first and second electrodes 110, 130 becomes zero, and the free electrons and holes having been spread out on both surfaces of the semiconductor layer 120 are now recombined inside the semiconductor layer 120. Therefore, the second electrode 130 is normally separated from the semiconductor layer 120, and no sticking occurs therebetween. In consequence, the MEMS RF-switch is normally turned off.

Figure 6:
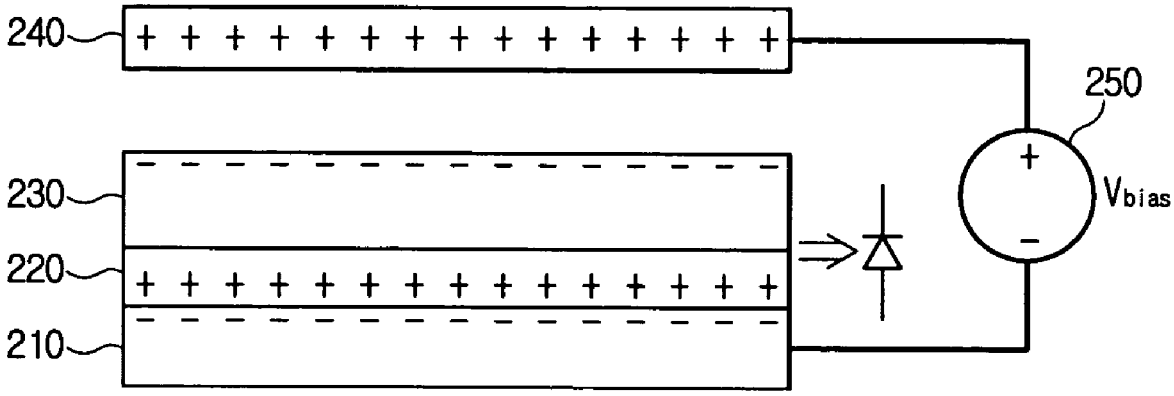
FIGS. 6-8 illustrate, respectively, the structure of an RF-switch according to another exemplary embodiment of the present invention.

FIG. 6 illustrates the structure of an RF-switch according to another exemplary embodiment of the present invention. Referring to FIG. 6, the MEMS RF-switch in this exemplary embodiment includes a first electrode 210, a P-type semiconductor layer 220, an N-type semiconductor layer 230, and a second electrode 240. The first electrode 210 and the second electrode 240 are coupled to both ends of an external power source 250, respectively.

The P-type and N-type semiconductor layers 220, 230 are combined with each other, forming the PN-junction diode. As depicted in FIG. 6, when the first electrode 210 and the second electrode 240 are coupled to the (−) terminal and the (+) terminal of the external power source 250, respectively, a reverse bias is applied to the PN-junction diode. Therefore, a potential barrier is created between the PN-junction diodes and the semiconductor layers become insulated. Consequently the MEMS RF-switch is turned on, allowing the RF signal to pass therethrough.

Figure 7:
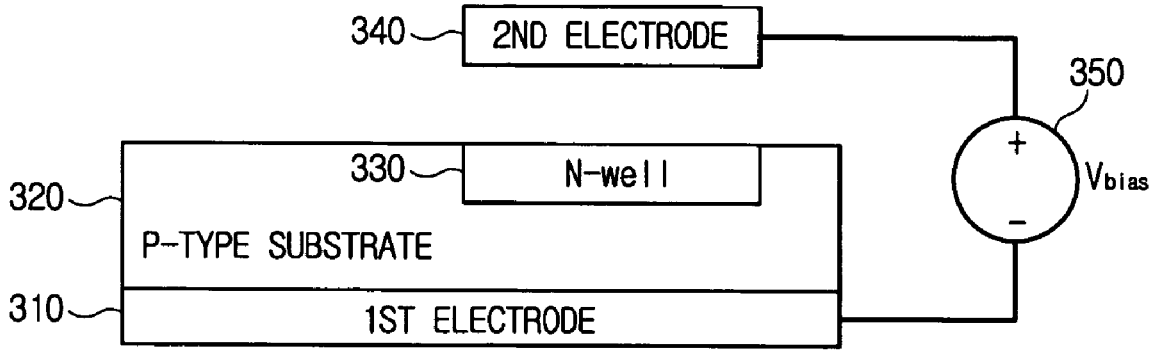

FIG. 7 illustrates the structure of an RF-switch according to yet another exemplary embodiment of the present invention. Referring to FIG. 7, the MEMS RF-switch in this exemplary embodiment includes a first electrode 310, a P-type substrate 320, an N-well 330, and a second electrode 340. The N-well 330 is fabricated by doping a certain portion of the upper surface of the P-type substrate 320, thereby forming the structure of a PN-junction diode. In short, when a bias signal is applied from the external power source 350, the MEMS RF-switch starts operating based on the exactly same principle used for the MEMS RF-switch of FIG. 6.

Figure 8:
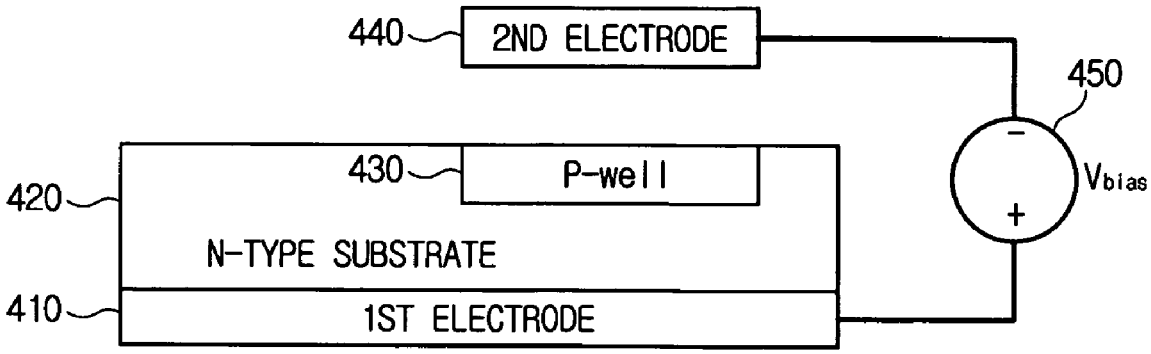

FIG. 8 illustrates the structure of an RF-switch according to still another exemplary embodiment of the present invention. In FIG. 8, the bias direction of an external power source 450 is reversed. That is, a first electrode 410 and a second electrode 440 are coupled to the (+) terminal and the (−) terminal of the external power source 450, respectively. A certain portion of the upper surface of an N-type substrate 420 is doped by a P-well 430, thereby forming the structure of a PN-junction diode. As a result, when a bias signal is applied from the external power source 450, the MEMS RF-switch starts operating based on the exactly same principle used for the MEMS RF-switch of FIG. 6.

In the exemplary embodiment of present invention, the first electrodes 110, 210, 310, 410 and the second electrodes 130, 240, 340, 440 are made of conductive materials including metal, amorphous silicon and poly-silicon. It is beneficial to fabricate electrodes by using the materials used in the CMOS (Complementary Metal-Oxide Semiconductor) fabrication because all the existing CMOS fabrication facilities and procedures can be compatibly used.

Figure 1:
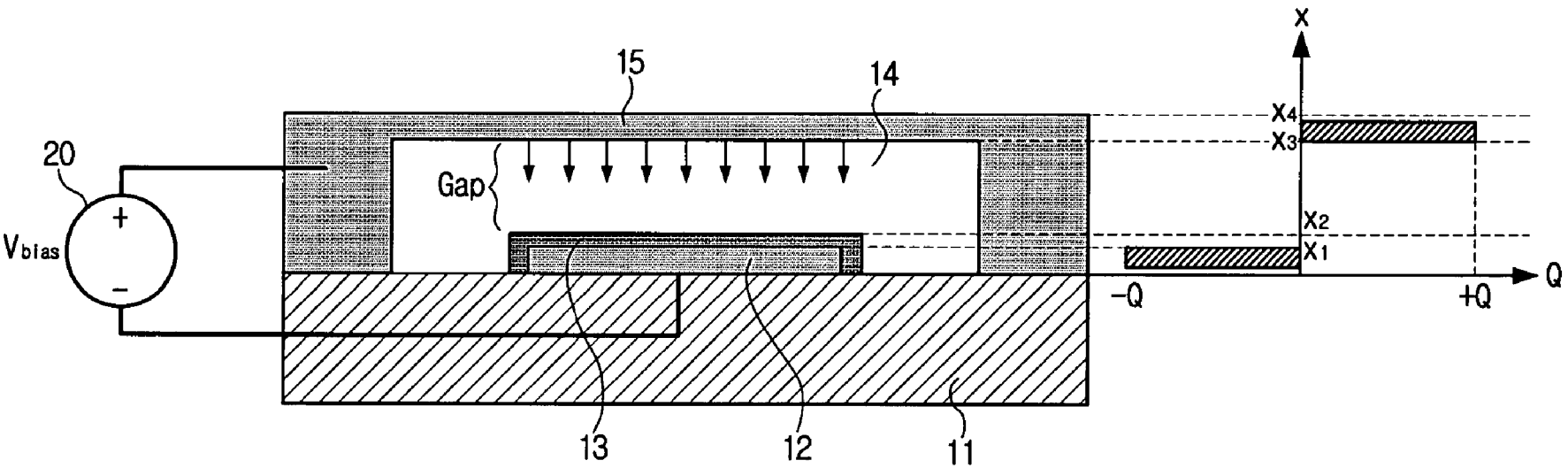
FIG. 1 (PRIOR ART)
FIG. 1 is a schematic cross-sectional view of a related art MEMS RF-switch.
Figure 2A:
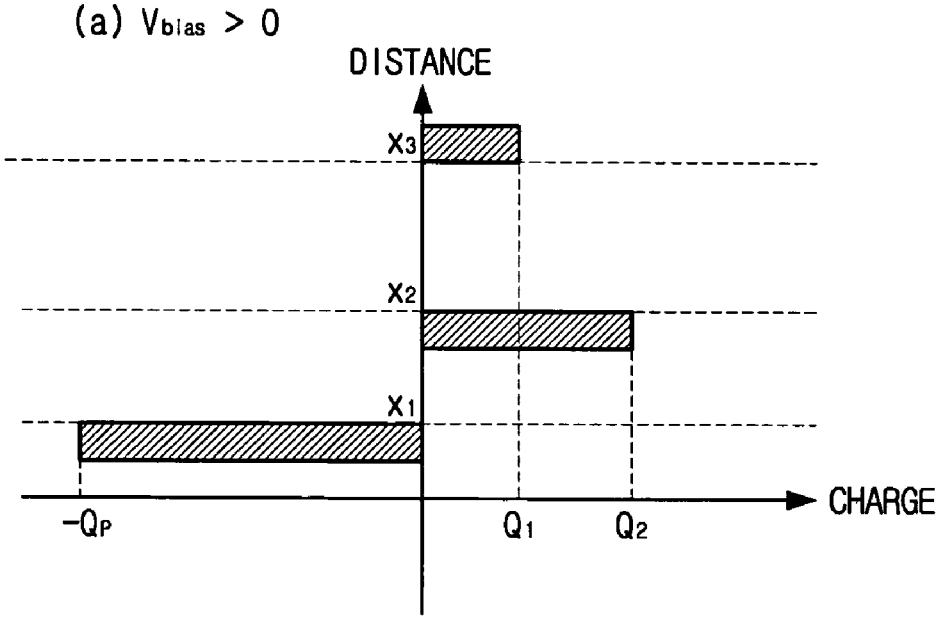
FIG. 2A (PRIOR ART)
FIGS. 2A and 2B illustrate the operation of the MEMS RF-switch of FIG. 1.
Figure 2B:
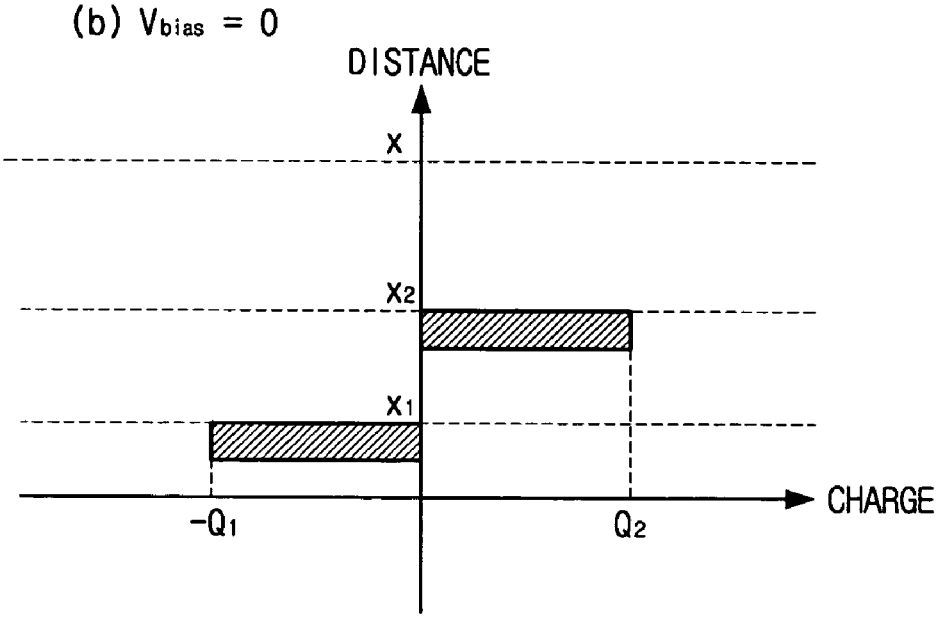
FIG. 2B (PRIOR ART)

In addition, the second electrodes 130, 240, 340, 440 can have the cap structure or the cantilever structure. As the name implies, the second electrode 130, 240, 340 or 440 of the cap structure covers the first electrode and the semiconductor layer from a predetermined distance. The cap structure is well depicted in FIG. 1, so further details will not be necessary.

Figure 9:
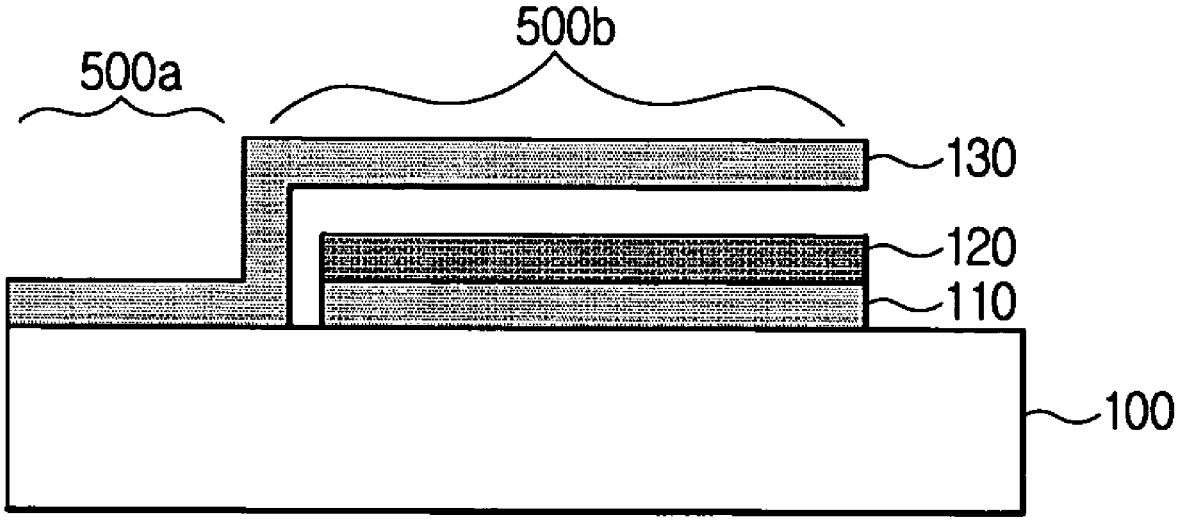
FIG. 9 is a schematic cross-sectional diagram of a cantilever type RF-switch of FIG. 3.

FIG. 9 is a schematic cross-sectional diagram of a cantilever type RF-switch according to the exemplary embodiment of FIG. 3. As shown in FIG. 9, a part of the second electrode 120 makes contact with the substrate 100 and forms a support part 500*a* . Also, another part of the second electrode 130 forms a protruded part 500*b* being protruded from the support part 500*a* so that it is a predetermined distance away from the first electrode 110 and the semiconductor layer 120. When a bias signal is applied from outside, the protruded part 500*b* moves downward and makes contact with the semiconductor layer 120.

In conclusion, the MIM-structured RF-switch based on the MEMS utilizes the semiconductor layer instead of the insulator to allow AC signals to pass therethrough. Therefore, when the bias signal is applied, the potential barrier is formed on the semiconductor layer, thereby making the semiconductor layer insulated. In this manner, the semiconductor layer can transmit AC signals. When the bias signal is cut off, on the other hand, free electrons and holes in the semiconductor layer are recombined, whereby charge buildup and sticking can be prevented. In addition, by manufacturing the first and second electrodes out of poly-silicon or amorphous silicon, all the existing CMOS fabrication processes can be compatibly used with the exemplary embodiments of the present invention.

The foregoing embodiments are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A MEMS RF-switch connected to an external power source for controlling switching on or off of transmission of AC signals, the MEMS RF-switch comprising:

a first electrode which is coupled to a first terminal of the power source;

a semiconductor layer which is combined with an upper surface of the first electrode, said semiconductor layer forming a potential barrier which is insulated when a bias signal is applied from the power source; and a second electrode which is disposed at a predetermined distance from the semiconductor layer and coupled to a second terminal of the power source, wherein said second electrode contacts the semiconductor layer when the bias signal is applied from the power source, wherein the semiconductor layer is made of predetermined semiconductor material.

2. The MEMS RF-switch according to claim 1, wherein the semiconductor layer comprises a P-type semiconductor layer and an N-type semiconductor layer.

3. The MEMS RF-switch according to claim 2, further comprising:

a substrate which is connected to a lower surface of the first electrode, said substrate supporting the first electrode, the semiconductor layer and the second electrode.

4. The MEMS RF-switch according to claim 3, wherein the second electrode includes a cap structure for covering the first electrode and the semiconductor at the predetermined distance from the semiconductor layer.

5. The MEMS RF-switch according to claim 3, wherein the second electrode includes a cantilever structure, comprising a support part which is connected to a predetermined region of the substrate, and a protruded part which is supported by the support part at the predetermined distance from the semiconductor layer.

6. The MEMS RF-switch according to claim 1, wherein at least one of the first electrode and the second electrode is made of one of metals, amorphous silicon and poly-silicon.

7. The MEMS RF-switch according to claim 1, wherein the semiconductor layer comprises one of an intrinsic semiconductor, a P-type semiconductor and an N-type semiconductor.

8. The MEMS RF-switch according to claim 1, wherein when the bias signal is applied from the power source, the semiconductor layer generates a barrier by the layout of free electrons and holes therein.

9. The MEMS RF-switch according to claim 8, wherein the free electrons of the semiconductor layer are laid out on a portion of the semiconductor layer closest to a positively charged one of the first electrode and the second electrode, and the holes are laid out in a portion of the semiconductor layer closest to a negatively charged one of the first electrode and the second electrode.

10. The MEMS RF-switch according to claim 8, wherein the free electrons and the holes are recombined inside the semiconductor layer when application of the bias signal is disrupted.

11. The MEMS RF-switch according to claim 1, wherein the semiconductor layer allows AC signals to pass therethrough.

* * * * *